United States Patent [19]

Litzinger et al.

[11] 4,273,575

[45] Jun. 16, 1981

[54] PROCESS FOR TRANSFORMING FINES OF IRON OR MANGANESE INTO RAW-MATERIAL FOR SINTERING

[75] Inventors: Bernardo C. Litzinger; Udo F. M. Schmeling, both of Rio de Janeiro, Brazil

[73] Assignee: Mineracoes Brasileiras Reunidas S.A., Rio de Janeiro, Brazil

[21] Appl. No.: 24,400

[22] Filed: Mar. 27, 1979

[30] Foreign Application Priority Data

Mar. 31, 1978 [BR] Brazil ..... 7802010

[51] Int. Cl.[3] ..... C22B 1/243; C22B 1/244

[52] U.S. Cl. ..... 75/3; 75/5

[58] Field of Search ..... 75/3–5, 75/25, 256; 23/313 R, 313 P; 264/111, 117

[56] References Cited

U.S. PATENT DOCUMENTS

| | | | |
|---|---|---|---|
| 2,417,493 | 3/1947 | Holz | 75/3 |
| 2,996,372 | 8/1961 | Impevato, Jr. | 75/3 |
| 3,235,371 | 2/1966 | Volin et al. | 75/3 |
| 3,313,617 | 4/1967 | Ban et al. | 75/5 |
| 3,382,063 | 5/1968 | Impevato, Jr. | 75/3 |
| 3,689,249 | 9/1972 | Judd | 75/3 |
| 3,984,229 | 10/1976 | Gorling | 75/3 |
| 4,082,539 | 4/1978 | Sugawara | 75/3 |
| 4,102,674 | 7/1978 | Osterloh et al. | 75/3 |
| 4,139,587 | 2/1979 | Cox | 75/3 |

OTHER PUBLICATIONS

Lange, *Handbook of Chemistry*, Handbook Publishers, Inc. p. 857, (1946).

*Primary Examiner*—Michael L. Lewis
*Attorney, Agent, or Firm*—Brumbaugh, Graves, Donohue & Raymond

[57] ABSTRACT

Ore fines whose particles are nearly all below 150 microns in size are converted into material suitable for use in forming sinter by the addition of agglomerants to these ore fines, the subsequent pelletizing of the mixture into spheres with a maximum size range of 6 mm, and the hardening of the spheres by curing them at temperatures below 300° C.

3 Claims, 1 Drawing Figure

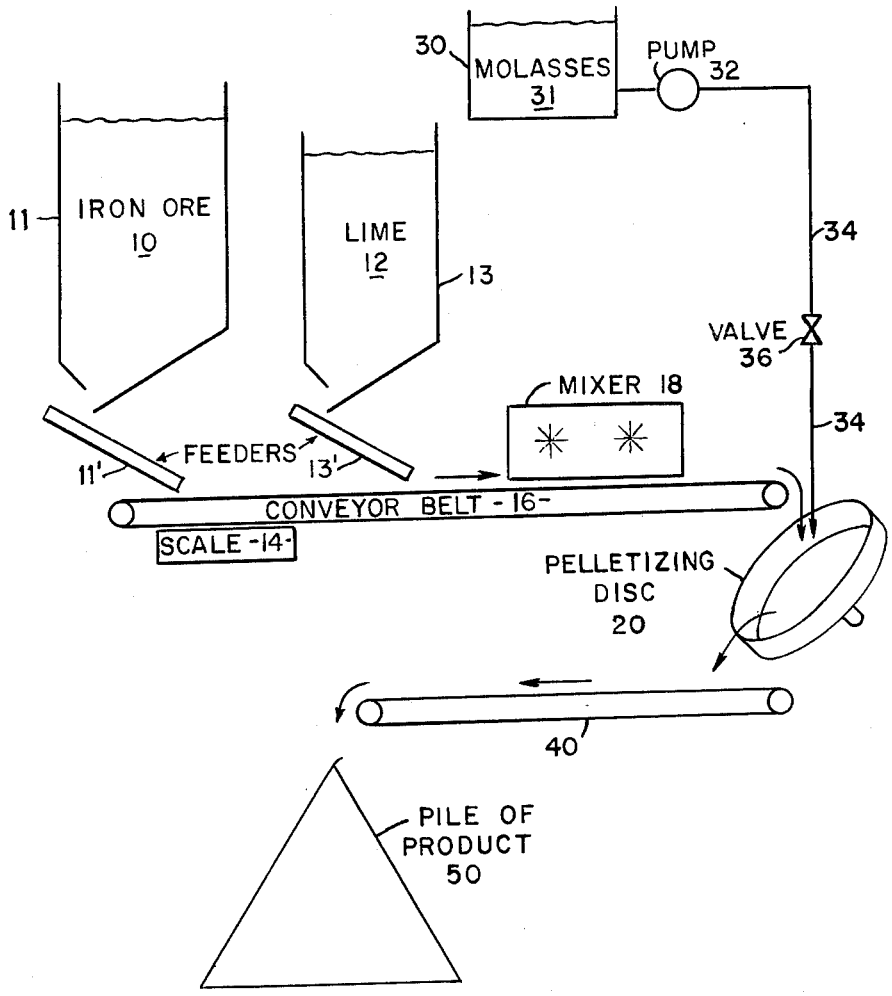
30
MOLASSES
31
PUMP
32
11
IRON ORE
10
LIME
12
13
34
VALVE
36
MIXER 18
34
FEEDERS
11'
13'
CONVEYOR BELT - 16-
SCALE -14-
PELLETIZING
DISC
20
40
PILE OF
PRODUCT
50

PROCESS FOR TRANSFORMING FINES OF IRON OR MANGANESE INTO RAW-MATERIAL FOR SINTERING

BACKGROUND OF THE INVENTION

The present invention is related in a general way to processes for the treatment of ore to prepare it as raw material for steel-making processes, notably those involving steel-making furnaces, and is particularly related to the process of preparing sinter.

Presently sinter represents the main raw material used in the world for feeding steel-making furnaces. Sinter is formed when (1) a certain portion of iron ore and/or manganese is mixed in defined proportions with coke or coal and other additives, (2) the mixture is subjected to high temperatures derived from the combustion of this coke or coal, and (3) it is agglomerated by incipient fusion of the particles of ore so as to form solid sinter particles having considerable porosity and mechanical resistance. These sinter particles are ideal for the feeding of steel-making furnaces.

The size range of the ore used in the sintering process is, however, limited in its lower range. In particular ore having more than 40% of its particles with a size below 150 microns is unacceptable for this purpose because of the risk of attaining an economically unacceptable yield in the process of sintering. The low yield is due to the obstruction by the fine ore particles of the passage of the gases necessary for the combustion of the coke or coal. Therefore, a great number of iron ore and/or manganese mining companies are faced with the problem of disposing of considerable stocks of ore fines (i.e. ore with a substantial proportion of particle sizes below 150 microns) which fines cannot be used for sintering. Part of these fines, however, can be pelletized, after which they are used directly in the steel-making furnaces without being sintered.

Pelletizing consists in the formation of spheres of ores of a diameter from 6 to 18 mm by discs, cones or pelletizing drums and the hardening of these spheres in special furnaces at temperatures averaging 1300°-1400° C. This process, however, is costly since it involves a high consumption of combustibles and power.

Other pelletizing processes of restricted use are also known. In these other processes, pellets of conventional size (6 to 18 mm) are produced in discs, cones or pelletizer drums from ore to which cement has been added, and the pellets are hardened by heat treatment at lower temperatures. These pellets are also designed for the direct feeding of blast furnaces.

There is, however, the need for a process which allows for the use of fines with particle size ranges below 150 microns at a cost below that of the conventional pelletizing processes.

SUMMARY OF THE INVENTION

The present invention is directed to the transformation of iron or manganese fines into raw-material for the sintering process through the agglomeration of these fines into small particles through the use of specific agglomerants. This process is practical and of lower cost because it allows for the creation of raw-material for the sintering process from fines of ore where the sole alternative use is in the conventional pelletizing processes.

In an illustrative embodiment of the invention an ore fine with substantially all of its particles of a size less than 150 microns, is mixed with agglomerants such as lime. The mixture is conducted to a pelletizer where spheres are formed. Before the spheres reach a diameter of 6 mm, they are discharged into silos where they are hardened by subjecting them to controlled humidity and temperatures below 300° C. for a period of several days. These hardened spheres or micro-pellets may then be transported to a sintering plant where they are formed into the sinter used in steel making furnaces.

According to a preferred embodiment of the present invention the micro-pellets are hardened at an accelerated rate by injecting $CO_2$ into the atmosphere surrounding the spheres in the silo.

BRIEF DESCRIPTION OF THE DRAWINGS

The foregoing and other features of the present invention will be more readily apparent from the following detailed description and drawing of apparatus for carrying out an illustrative embodiment of the present invention.

DESCRIPTION OF AN ILLUSTRATIVE EMBODIMENT

The process of the present invention is very useful in that it is the only process known to the inventors which allows iron or manganese ore with a substantial part of its particle size range under 150 microns, to be used to form micro-pellets with a size range adequate for the economical production of sinter, which pellets are also capable of resisting size degradation due to handling and transportation.

In the process carried out by the apparatus in the drawing, iron ore or manganese ore with a substantial porportion of particles having a size below 150 microns and a humidity below 15%, is mixed with agglomerants (e.g. lime, cement, bentonite, calcium chloride, silicate or fluorsilicate of sodium, and cane molasses) in proportions that vary in accordance with the characteristics of the ore. The ore 10 is stored in a bin or silo 11 and one of the agglomerants, e.g. hydrated lime 12, is stored in a smaller silo 13. By means of a scale 14 located below a conveyor belt 16, a proportion by weight of the ore (e.g. 95%) and the lime (e.g. 5%) is loaded onto the belt by means of vibratory feeders 11' and 13' positioned on the bins 11 and 13, respectively. The ore and lime are then mixed in a conventional belt mixer 18 located along the conveyor belt.

The ore mixed with the lime agglomerant is then conveyed by the conveyor belt 16 to pelletizer equipment 20 which may be of the conventional disc, drum or cone type. In the pelletizer 20 the mixture forms into spheres. If desired the formation of the sphere can be enhanced by adding cane molasses 31 from tank 30 to the pelletizer by means of pump 32, conduit 34 and valve 36. The spheres are discharged from the pelletizer as micro-pellets before reaching a maximum diameter of 6 mm. There is no minimum size for the individual micro-pellets, but no more than 40% of them should be less than 150 microns in a representative sample. These micro-pellets are then conveyed via another conveyor belt 40 to a silo or stockpile 50, where the agglomerants are cured to harden the pellets. This hardening takes place at temperatures between ambient and 300° C. at controlled humidities during a period of several days until the micro-pellets are hard enough to resist degradation by handling and transportation.

The hardening process can be accelerated by injecting an atmosphere of $CO_2$ around the micro-pellets while they are in silo 50. After the curing period, the hardened micro-pellets can be handled by the same conventional equipment used for recovery and transport of ore with an equivalent size range. The micro-pellets, either together with ore or separately, are used to produce a sinter in a conventional manner, which sinter can be fed to the steel-making furnaces.

EXAMPLE

Iron ore fines having 90% of their particles with sizes below 150 microns and close to 8% humidity were conveyed from stocking silo 11 to conveyor belt 16 by means of vibratory feeder 11'. Scale 14 was used to assure that close to 5% by weight of hydrated lime was added to the ore on the conveyor belt 16 from silo 13. These particles were then passed through the conventional belt mixer 18, after which they were conveyed to a pelletizer disc. At the pelletizer disc, cane molasses was added to the mixture through a sprinkler in a proportion of close to 3% of the weight of the ore. The pelletizer disc had its operational characteristics adjusted in such a way that it unloaded the small spheres or micro-pellets before they reached the maximum size of 6 mm. The micro-pellets were then taken by conveyor belt 40 to the closed environment of silo 50, which was rich in $CO_2$. There the pellets were allowed to cure for a period of ten days at a temperature below 300° C., i.e. at 250° C. After being hardened by the curing process the pellets were handled by conventional equipment and conveyed to the sintering plant for transformation into sinter.

While the invention has been particularly shown and described with reference to a preferred embodiment thereof, it will be understood by those skilled in the art that various changes in form and details may be made therein without departing from the spirit and scope of the invention. In particular the invention is not limited to the use of conveyor belts, i.e. chutes may also be used to transport the particles in carrying out the process. Also, the invention is broad enough to use any agglomerants and not just those described.

We claim:

1. A process from transforming ore fines having a substantial proportion of particles with sizes below 150 microns into raw-material for a sintering process that produces raw material for steel-making furnaces, comprising the steps of:

mixing an iron ore fine with a lime agglomerant, the proportion of lime being 5% by weight;

adding 3% by weight of cane molasses to the mixture;

pelletizing the mixture to form micro-pellets having a diameter of less than 6 mm;

curing the micro-pellets in a closed environment at temperatures below 300° C. for a period sufficient to harden the pellets to such an extent that they are resistant to size degradation due to handling.

2. The process of claim 1 wherein the temperature for curing is between ambient and 300° C.

3. The process of claims 1 wherein the curing is accomplished in a closed environment filled with carbon dioxide.

* * * * *

UNITED STATES PATENT AND TRADEMARK OFFICE

CERTIFICATE OF CORRECTION

PATENT NO. : 4,273,575

DATED : June 16, 1981

INVENTOR(S) : Bernardo Christovao Litzinger, Udo Frederico Meier Schmeling

It is certified that error appears in the above-identified patent and that said Letters Patent are hereby corrected as shown below:

Column 4, line 14, "from" should read --for--.

Signed and Sealed this

First Day of September 1981

[SEAL]

Attest:

GERALD J. MOSSINGHOFF

Attesting Officer

Commissioner of Patents and Trademarks